United States Patent [19]

Hermanson

[11] Patent Number: 4,848,741

[45] Date of Patent: Jul. 18, 1989

[54] DEVICE FOR APPLICATION OF DYNAMIC FORCE AND SIMULATION OF MOVEMENTS

[76] Inventor: Carl G. Hermanson, Grandongevägen 6, S-75246 Uppsala, Sweden

[21] Appl. No.: 195,214

[22] Filed: May 18, 1988

[30] Foreign Application Priority Data

May 18, 1987 [DE] Fed. Rep. of Germany ... 8707106[U]
Dec. 15, 1987 [DE] Fed. Rep. of Germany ... 8716547[U]

[51] Int. Cl.[4] ..... A63B 21/02
[52] U.S. Cl. ..... 272/135; 272/142
[58] Field of Search ..... 272/135–139, 272/142, 143, 131–133, 93

[56] References Cited

U.S. PATENT DOCUMENTS

| | | | |
|---|---|---|---|
| 418,257 | 12/1889 | Whitely | 272/136 |
| 3,561,758 | 2/1971 | Huber | 272/133 |
| 4,693,471 | 9/1987 | Dofel | 272/133 |

*Primary Examiner*—Richard J. Apley
*Assistant Examiner*—J. Welsh
*Attorney, Agent, or Firm*—Becker & Becker, Inc.

[57] ABSTRACT

A device for the application of dynamic forces on, and/or for simulation of movements by, a training person that is using the device. Disposed on a base plate are at least three spaced-apart deflecting elements that accommodate and guide an elastic band.

9 Claims, 2 Drawing Sheets

DEVICE FOR APPLICATION OF DYNAMIC FORCE AND SIMULATION OF MOVEMENTS

BACKGROUND OF THE INVENTION

This innovation relates to a device for the application of dynamic forces on, and/or for simulation of movements by, a training person using said device.

It has been known in the prior art to use an elastic band, preferably made of a rubber mixture, for the application of dynamic forces on, and for simulation of movements by, a training person using the same. Such a band can for instance be used as an expander, or by one of its ends can be attached to a wall and on its other end grasped by the hand of the training person and pulled so that depending on the type of tension load applied, this person has to overcome varying forces. Such a band commercially available on the market has its ends provided with loops to thereby make it easier for it to be fixed to a wall and/or for its free end to be gripped by the training person's hand or foot.

Different forces or loads to be applied can only be set via different elongations of the band or different points of force attack or application. In addition, suitable attaching means are not always available so that the range of possible uses and the simulation of movements of the band are restricted.

It is an object of this present innovation, therefore, to improve a device of the type hereinbefore defined in such a way that the forces to be applied by the training person when using the elastic band are adjustable and/or that a plurality of different movements such as involved in various kinds of sport can be simulated with the aid of said device.

SUMMARY OF THE INVENTION

The innovator has discovered that to achieve this goal the elastic band must be afforded guiding action by a base plate and that said guiding action must be adjustable and variable, which means that different tension states of the elastic band can be set.

The physical configuration of the novel device is characterized by a base plate on which at least three spaced-apart deflecting elements are fitted to accommodate and guide the band.

Three such deflecting elements are minimum and result in triangular guidance of the band, but more than just three of them should preferably be disposed on the plate, i.e. in substantially arbitrary relative arrangement so that a variety of guide paths are created for the band that passes around the deflecting elements.

The deflecting elements may be arranged such that the band is guided in a member or zigzag pattern, or generally expressed in different sections disposed under different angles.

A particularly advantageous embodiment provides for at least one of the deflecting elements to be adjustably or shiftably fitted on the base plate. This will enable the guiding path of the elastic band to be set, and hence also the band's pretension, with the consequence for the training person being that forces of different magnitude have to be exerted for subsequent stretching of the elastic band.

Two deflecting elements at least, i.e. those around which the free endsof the band are run, will preferably be disposed in such a way that they dependably retain the free band ends, which means that the band should be effectively kept from slipping behind said deflecting elements in these spots so that it can be safely gripped at all times. This goal can be achieved for instance by providing the deflecting elements in the form of deflecting rolls which are opposed by corresponding brake rolls so that one deflecting roll and one brake roll keep the band between them by friction.

The free ends of the elastic band are preferably fitted with grip elements such a loops. To make sure that the band will not slip off after use, holding clips or the like can be additionally fitted beside or beneath those deflecting rolls around which the free ends of the band are run, in order to keep the loops in place.

A particularly advantageous embodiment of this present innovation provides for at least five deflecting elements to be disposed on the base plate in such relative arrangement that they are located at the tips of an imaginary "M".

It is preferred in this embodiment that the deflecting element in the center be adjustable relative to the symmetry axis of said "M", which makes it particularly easy to set band pretensions of different magnitudes.

The device according to this present innovation, the essential components of which are the base plate and its associated deflecting elements to guide the elastic band, offers a number of surprising and advantageous applications for strength training or simulation of movements, for instance movements of the type involved in skiing and long-distance skiing, but also for muscle training in general or during rehabilitation after injuries, etc.

The path of the elastic band, as defined by means of the deflecting rolls for instance, makes it possible after setting a given pretension, to stick one foot through one loop of the band whereupon the training person moves that foot away from the base plate in different directions to thereby stretch the band while at the same time overcoming a force which is dependent on said pretension setting. In this way it is readily possible to simulate so-called skating steps for long-distance skiing.

It is advantageous particularly for the range of applications last mentioned to hinge another plate to the base plate, preferably in the area of those deflecting rolls which accommodate the free ends of the elastic band. The training person is thus allowed to stand on said additional plate with one foot, and to do the desired movements with the other foot stuck through the loop of the elastic band, without risking slippage of the device as a whole. This additional plate hence serves as a stand plate.

A few of the deflecting elements at least are preferably provided as deflecting rolls, as stated earlier, so that a guiding action will be particularly easy to achieve.

Gimbal suspension of the deflecting elements also makes it possible to move the elastic band out of the base plate plane with exceptional ease, especially in the area of the free ends thereof.

Providing the deflecting elements as brake rolls, or instance, will ensure that the movements towards band pretension will be "gentle" rather than abrupt.

Besides providing for adjustability of individual deflecting elements at least, as earlier mentioned, it is also possible to make the base plate as such variable in length or width. This automatically results in a different allocation of deflecting elements and hence in another possibility for setting the pretension of the elastic band.

Provision is also made for the base plate to be provided with at least two holes, thus permitting the device to be secured to a floor, a wall or a door.

Different fixing means may take the place of said holes such as hooks or the like; also, the base plate may be fitted with fixing clamps or straps in its marginal areas for attachment to a door or the like. In that case it would do, for instance, to clamp such bands between door and frame.

The base plate may be arranged in a vertical, horizontal or any other position depending on what force attack points will be set or which movements are to be simulated.

Other ways to fix the device besides these hereinbefore defined and explained may be snap-type or other frictional or positive connections to increase the convenience of use thereof even further.

Further specific features of the present invention will be described in detail subsequently.

BRIEF DESCRIPTION OF THE DRAWINGS

A number of exemplified embodiments of this innovation shall now be described in closer detail with reference to the accompanying schematic drawings, in which.

DESCRIPTION OF PREFERRED EMBODIMENTS

Figure 1:
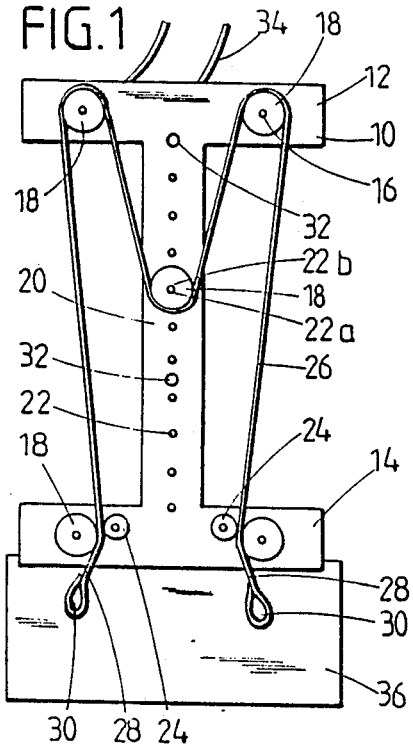
FIG. 1 is a top view of a first exemplary embodiment of the device according to the present innovation.

Referring now to the drawings in detail, essentially identical structural elements are denoted by identical reference numerals in the figures for sake of clarity and easier comprehension.

FIG. 1 shows a base plate 10 which is of double-Tee configuration. The outer ends of the T-shaped legs 12, 14 each carry an axle or shaft 16 which is secured into the base plate 10 and which carries one rotatable deflecting roll 18.

The section 20 that extends between the Tee legs 12, 14 comprises a plurality of spaced apart cavities or holes 22, with a cavity **22*a* receiving a plug pin 22*b* that extends perpendicularly from the base plate 10 and likewise carries a deflecting roll 18**.

A brake roll 24 is arranged to coact with each of the deflecting rolls disposed in the lower leg 14 in a staggered relation thereto.

The allocation of the deflecting rolls 18 in this exemplified embodiment has been selected such that said deflecting rolls are located at the tips or peaks of an imaginary letter "M" so that consequently the elastic strap 26 that runs around said deflecting roll 18 also has the configuration of an "M" as seen in top view representation.

In the area of the free ends 28, the band 26 will be guided between a roll pair, consisting of one deflecting roll 18 and a brake roll 24, under low friction with provision being made to prevent band slippage via friction therebetween and furthermore due to the fact that the free ends 28 are provided with straps or loops 30 which do not fit between any such roll pair comprising said deflecting roll 18 and said brake roll 24.

The band 26 will receive a defined pretension due to the arrangement as shown in FIG. 1 of said band 26 around the deflecting rolls 18. This pretension is easily variable in that the center-roll 18, rather than being plugged into the cavity **22*a*, can be plugged into any one of the cavities 22** thereabove or therebeneath. Any training person is thus enabled to vary the pretension of the band with the simplest means, and within a minimum of time, to thereby set a variety of pretension states and/or to simulate a variety of movements.

Holes 32 in the section 20 as shown in FIG. 1 permit the whole or entire device to be screwed to a floor, a wall or a door.

FIG. 1 also shows fixing belts 34 hinged to the upper T-leg 12, which belts also serve to fix and arrest the device and which can for instance be clamped between a door and a door frame.

Another plate 36 is hinged to the lower T-leg 14 in the embodiment according to FIG. 1 for the training person to stand on. Accordingly, the device can also be used, in the absence of any additional attachments, in such cases for instance where a training person wishes to do leg training and with his/her left leg stands on plate 36 while the foot of his/her right leg has been stuck through said loop 30. Even when moving the right foot away from the device (while at the same time tensioning or stretching the elastic band 26), the device as a whole undergoes no displacement whatsoever because of the load that the left foot applies to said plate 36.

It goes without saying that to set the guided length of the elastic band 26 it is not only the central deflecting element 18 that can be shiftable; rather, the other deflecting rolls 18 can also be variable in addition or alternatively, or even the length of the base plate 10, which should preferably be of telescoping type in such a case, to thereby change and set the relative distance between said deflecting elements 18.

FIGS. 2 to 5 show alternative modifications of the device, especially due to different arrangements of the deflecting elements 18. The base plates in these embodiments are of rectangular configuration, as seen in top view representation, and the arrangement and type of attachment of the individual components thereof are analogous to what has hereinbefore been described in this regard.

Figure 2:
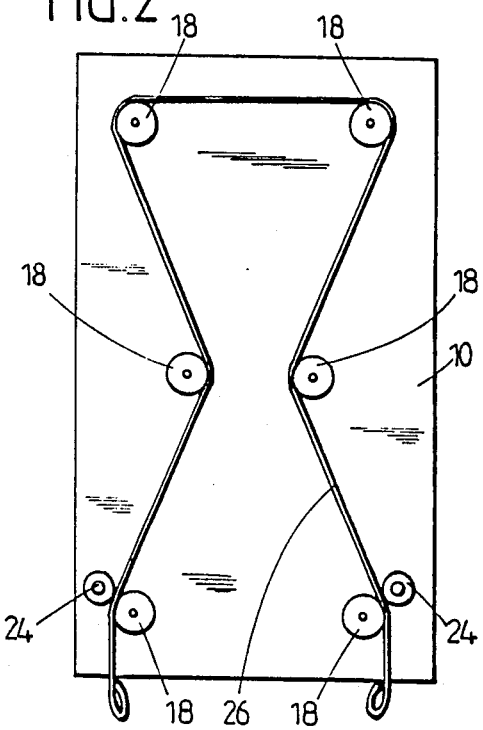
FIG. 2 is a top view of a second exemplary embodiment of the device according to the present innovation.

In the embodiment according to FIG. 2, however, there are as many as six deflecting rolls 18 provided which are arranged in pairs, side by side, at the upper and lower end of the plate as well as in the center thereof, with those deflecting rolls 18 that are disposed at closer spacings in the figure than the other deflecting roll pairs being shiftable to the right or left so that another possibility is created for changing the pretension of said elastic band 26.

Figure 3:
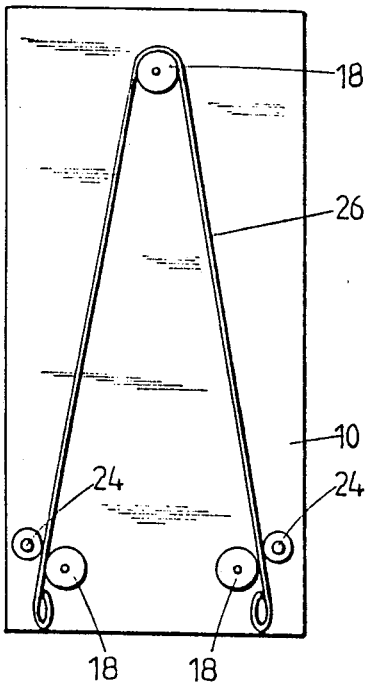
FIG. 3 is a top view of a third exemplary embodiment of the device according to the present innovation.

The embodiment according to FIG. 3 is particularly simple as it comprises only three deflecting rolls 18, two of which are disposed at the lower end of the plate in conformity with FIGS. 1, 2 while the third deflecting roll is arranged intermediately of said two rolls at the opposite end of the plate. Said third deflecting roll can again be fixed in different plug positions similar to what has been described for the center-arranged deflecting roll 18 as per FIG. 1. This creates another possibility to vary the pretension of the elastic band 26.

Figure 4:
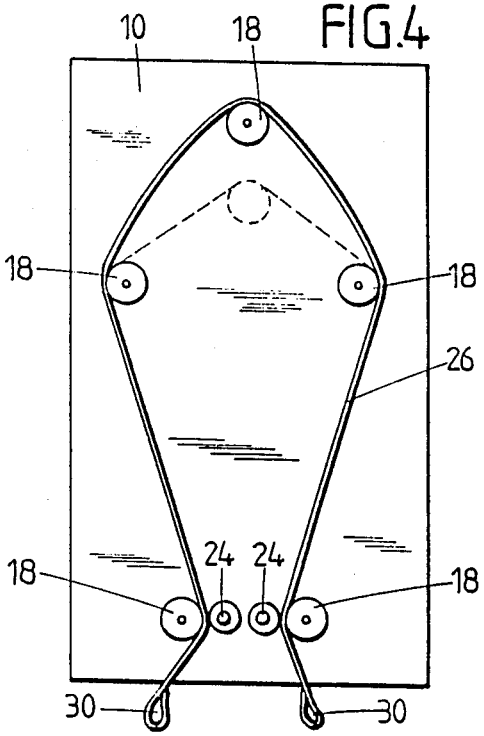
FIG. 4 is a top view of a fourth exemplary embodiment of the device according to the present innovation.

The embodiment according to FIG. 4 is similar to the one represented in FIG. 1, though the fifth deflecting roll 18 is in that case not disposed inbetween the other four deflecting rolls, but is arranged above the upper deflecting roll pair, though again being adjustable just like the center-arranged deflecting roll 18 in FIG. 1. FIG. 4 reflects two different roll allocations and/or relative arrangements as identified by one solid and one dash line.

Figure 5:
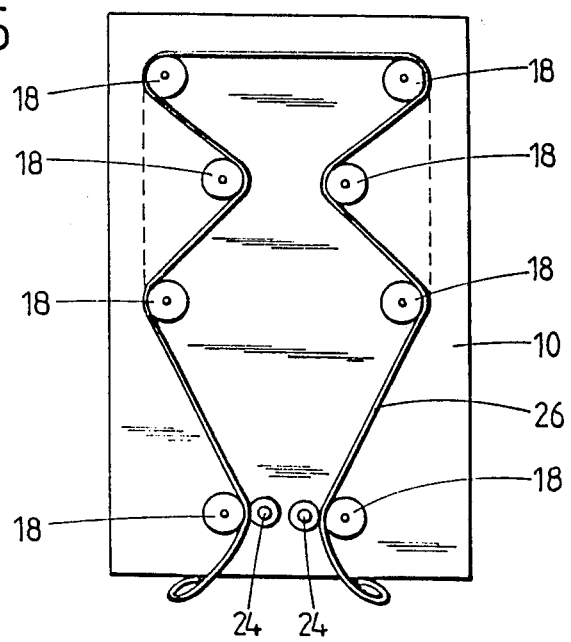
FIG. 5 is a top view of a fifth exemplary embodiment of the device according to the present innovation.

The embodiment according to FIG. 5 finally comprises eight deflecting rolls which are arranged in pairs at different relative spacings; here again, there are shown two different guide paths of the elastic band 26, identified by one solid and one dashed line. Only six deflecting rolls are needed to guide the band on the path shown in dashline representation, and it is evident here that the elastic band 26 has less pretension imparted to it than it would have if it would be "meandered" via the other two rolls also.

Figure 6:
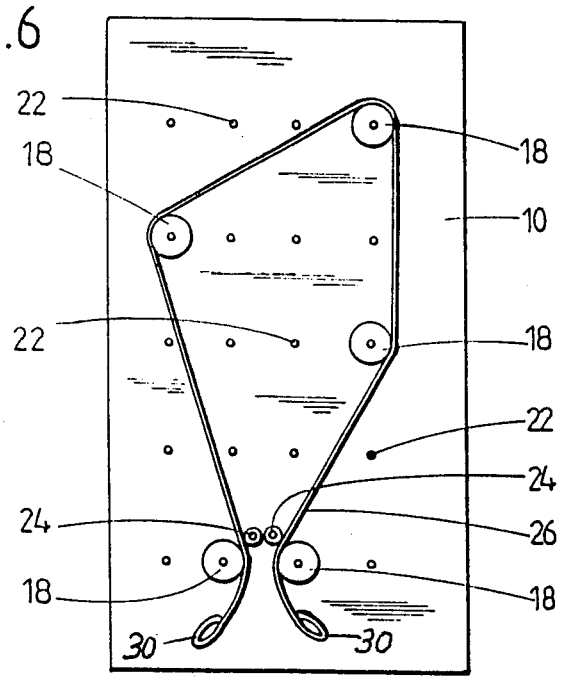
FIG. 6 is a top view of a sixth exemplary embodiment of the device according to the present innovation.

The variety of geometrical arrangements of said deflecting rolls 18 on base plate 10 is particularly evident in the exemplified embodiment according to FIG. 6, which hows that a plurality of cavities 22 are provided in the base plate 10 in statistical distribution, which cavities are adapted to receive axle-mounted deflecting rolls 18 in any desired relative arrangement to thereby achieve different geometries and hence different pretensions of the elastic band 26.

Other modifications of the device according to this present innovation are readily conceivable, and in particular it is possible to vary the number and arrangement of the deflecting elements almost arbitrarily. The embodiment specifically preferred, however, is one similar to that represented in FIG. 1, the reason being that it is particularly simple and yet makes it possible to create a plurality of different tension states in the elastic band. It goes without saying that the deflecting rolls may be substituted by other deflecting elements than those described, for instance pins or the like.

The present invention is, of course, in no way restricted to th specific disclosure of the specification and drawings, but also encompasses any modifications within the scope of the appended claims.

What I claim is:

1. A device for the application of dynamic forces on and for the simulation of movements by, a training person using that device which comprises:

a base plate, on which at least three spaced-apart deflecting rolls are disposed; and an elastic band that is accommodated and guided by said deflecting rolls, wherein at least one of said deflecting rolls is adjustably mounted on said base plate to result in substantially arbitrary relative arrangement of said deflecting roll and hence to vary pretension of the band so that forces of different magnitude may be exerted by said training person for subsequent stretching of said band and at least two deflecting rolls are arranged opposite to corresponding brake rolls for guiding said band between corresponding rolls by friction, these pairs of rolls being arranged just before the free ends of said band.

2. A device according to claim 1, which includes five deflecting rolls that are disposed on said base plate in such a way as to define the tips of an imaginary "M".

3. A device according to claim 2, in which said deflecting rolls, in the center of said imaginary "M", is adjustable relative to an axis of symmetry of said "M".

4. A device according to claim 1, in which said base plate is provided with at least two holes to permit said device to be attached to support means, such as a floor, wall or door.

5. A device according to claim 1, in which said base plate is provided with fixing means to permit attachment of said device to support means, such as a floor, wall or door.

6. A device according to claim 5, in which said fixing means are in the form of fixing belts that are hinged to said base plate.

7. A device according to claim 1, in which said free ends of said elastic band are accommodated at one end of said base plate; and a further plate is hinged to said end of said base plate and is provided for a person to stand on.

8. A device according to claim 1, in which at least one of said deflecting rolls is mounted on said base plate in such a way as to be movable to an angle of 90° relative to said base plate.

9. A device according to claim 1, in which said base plate is provided with several holes, and in which at least one of said deflecting rolls is mounted in one of said holes in such a way that it can readily be removed and disposed in another one of said holes in order to provide different tensions for said elastic band.

* * * * *